US010612504B2

(12) United States Patent
Oge et al.

(10) Patent No.: US 10,612,504 B2
(45) Date of Patent: Apr. 7, 2020

(54) NOZZLE ASSEMBLY WITH ADAPTIVE CLOSED SIGNAL

(71) Applicant: Delphi International Operations Luxembourg, S.A.R.L., Bascharage (LU)

(72) Inventors: Jean-Christophe Oge, Neuvy (FR); Jorge Martinez, Blois (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 169 days.

(21) Appl. No.: 15/739,174

(22) PCT Filed: Jun. 8, 2016

(86) PCT No.: PCT/EP2016/063064
§ 371 (c)(1),
(2) Date: Dec. 22, 2017

(87) PCT Pub. No.: WO2016/206982
PCT Pub. Date: Dec. 29, 2016

(65) Prior Publication Data

US 2019/0301412 A1 Oct. 3, 2019

(30) Foreign Application Priority Data

Jun. 23, 2015 (GB) ..... 1511007.5

(51) Int. Cl.
*B05B 1/30* (2006.01)
*F02D 41/20* (2006.01)
(Continued)

(52) U.S. Cl.
CPC ..... *F02M 51/0603* (2013.01); *B05B 1/3053* (2013.01); *F02D 41/20* (2013.01);
(Continued)

(58) Field of Classification Search
CPC ..... F02M 51/0603; F02M 47/027; F02M 57/005; F02M 61/12; F02M 61/1886;
(Continued)

(56) References Cited

U.S. PATENT DOCUMENTS 2,017,028 A * 10/1935 Heinrich ..... F02M 61/06 239/453
4,784,178 A * 11/1988 Kasaya ..... F01L 9/04 123/305

(Continued)

FOREIGN PATENT DOCUMENTS

DE 10313623 A1 10/2004
DE 102004015745 A1 10/2005

(Continued)

*Primary Examiner* — Alexander M Valvis
*Assistant Examiner* — Joseph A Greenlund
(74) *Attorney, Agent, or Firm* — Joshua M. Haines

(57) ABSTRACT

A nozzle assembly of a fuel injector includes a nozzle body in which a needle member is adapted to translate. The nozzle assembly is further provided with an electrical circuit so that an electrical signal enabling contact detection is measurable between the needle member and the nozzle body. The nozzle assembly also includes a piezoresistive device which continuously varies the electrical signal during the final closing displacements, or the initial opening displacements, of the needle, the variations of the signal being a function of a differential pressure.

11 Claims, 4 Drawing Sheets

(51) Int. Cl.

| | |
|---|---|
| ***F02M 47/02*** | (2006.01) |
| ***F02M 51/06*** | (2006.01) |
| ***F02M 57/00*** | (2006.01) |
| ***F02M 61/12*** | (2006.01) |
| ***F02M 61/18*** | (2006.01) |
| ***F02M 65/00*** | (2006.01) |

(52) U.S. Cl.
CPC ..... *F02D 41/2096* (2013.01); *F02M 47/027* (2013.01); *F02M 57/005* (2013.01); *F02M 61/12* (2013.01); *F02M 61/1886* (2013.01); *F02M 61/1893* (2013.01); *F02M 65/005* (2013.01); *F02D 2041/2055* (2013.01); *F02D 2200/063* (2013.01); *F02M 2200/244* (2013.01); *F02M 2200/245* (2013.01); *F02M 2200/247* (2013.01); *F02M 2200/9038* (2013.01)

(58) Field of Classification Search
CPC ..... F02M 65/005; F02M 2200/244; F02M 2200/247; F02M 2200/9038; B05B 1/3053; F02D 41/2096; F02D 2041/2055
USPC ..... 239/11
See application file for complete search history.

(56) References Cited

U.S. PATENT DOCUMENTS 5,207,384 A * 5/1993 Horsting ..... F02M 51/06 239/114
5,595,215 A * 1/1997 Wallace ..... F02M 65/005 137/554
5,820,033 A * 10/1998 Cooke ..... F02M 47/027 239/585.5
6,367,153 B1 * 4/2002 Aota ..... F02M 51/0671 29/464
6,409,094 B2 * 6/2002 Tojo ..... F02M 47/027 239/5
6,874,475 B2 * 4/2005 Katsura ..... F02M 47/027 123/458
7,055,762 B2 * 6/2006 Gerber ..... F02M 65/005 123/617
9,309,850 B2 * 4/2016 Akazaki ..... F02M 61/14
9,726,126 B2 8/2017 Moreau et al.
2008/0042518 A1 * 2/2008 Liu ..... H01H 59/0009 310/319
2008/0237366 A1 * 10/2008 Ehlert ..... F02M 27/08 239/102.2
2010/0050991 A1 * 3/2010 Cooke ..... F02M 51/005 123/470
2010/0059021 A1 * 3/2010 Rau ..... F02D 41/2096 123/478
2013/0167808 A1 * 7/2013 Stucchi ..... F02D 41/402 123/478
2013/0270369 A1 * 10/2013 Peters ..... F02M 61/1866 239/533.2
2014/0067233 A1 * 3/2014 Nishida ..... F02D 41/20 701/103
2015/0108238 A1 * 4/2015 Grandi ..... F02D 41/221 239/5
2016/0281665 A1 * 9/2016 Moreau ..... F02M 51/0653
2017/0211533 A1 * 7/2017 Barbier ..... F02M 65/005
2017/0268473 A1 * 9/2017 Legrand ..... F02M 47/027
2018/0128225 A1 * 5/2018 Kounosu ..... F02M 59/10
2019/0136789 A1 * 5/2019 Satake ..... F02M 51/0614
2019/0170075 A1 * 6/2019 Satake ..... F02D 41/04
2019/0178189 A1 * 6/2019 Satake ..... F02D 41/20
2019/0203687 A1 * 7/2019 Yanoto ..... F02D 41/40
2019/0301412 A1 * 10/2019 Oge ..... F02D 41/20

FOREIGN PATENT DOCUMENTS

DE 102009029549 A1 3/2011
DE 102011016168 A1 * 10/2012 ..... F02M 47/02
DE 102011016168 A1 10/2012
FR 3013080 A1 5/2015
GB 1421737 A 1/1976

* cited by examiner

NOZZLE ASSEMBLY WITH ADAPTIVE CLOSED SIGNAL

CROSS REFERENCE TO RELATED APPLICATIONS

This application is a national stage application under 35 USC 371 of PCT Application No. PCT/EP2016/063064 having an international filing date of Jun. 8, 2016, which is designated in the United States and which claimed the benefit of GB Patent Application No. 1511007.5 filed on Jun. 23, 2015, the entire disclosures of each are hereby incorporated by reference in their entirety.

TECHNICAL FIELD

The present invention relates to a method enabling close loop control of a fuel injector by means enabling accurate injection state identification. The invention further relates to a method to implement such identification.

BACKGROUND OF THE INVENTION

In a fuel injector, the displacements of a valve member, or needle, between an open position and a closed position enable, or forbid, fuel injection through spray holes provided in the nozzle body of the injector. The needle is an elongated shaft-like member extending from a head portion, protruding in a control chamber, to a pointy extremity provided with a moving seating face that cooperates with a fixed seating face integral to the nozzle body. The needle is slidably guided between an upper guide and a lower guide arranged in the nozzle body and, in closed position the moving seating face is in sealing contact against the fixed seating face closing fluid communication to the spray holes and thus forbidding fuel injection and, in open position the moving seating face is lifted away from the fixed seating face thus opening said fluid communication and enabling fuel injection through the spray holes.

The needle moves under the influence of fuel pressure difference between the pressure in the control chamber that generates on the needle a closing force and, pressure on the pointy extremity of the needle that generates an opposed opening force.

The pressure difference alternates as the pressure in the control chamber raises to a first level where the closing force is predominant or, drops down to a second level where the opening force becomes predominant. The control chamber is fed with fuel at high pressure wherein, the pressure variation depends upon a control valve to open or to close a spill orifice enabling fuel to exit the control chamber and flow back to a return circuit toward a low pressure reservoir.

It is now known that major improvement in the control of fuel injection equipment and of the injection event is obtained with a so called closed-loop control method. In such method, executed by an electronic control unit (ECU) that controls the all operation of the fuel injection equipment and in particular the control valve of the fuel injector, the fuel injector is provided with close loop means enabling for an electrical signal to be measured at a specific value when the needle gets in closed position. In other disclosed embodiments, the signal can also take a specific value when the needle is in fully open position. Such close loop means typically comprise the electrical insulation of the needle relative to the nozzle body, to the exception of the moving seating face and fixed seating face that are electrically conductive so that, the needle and nozzle body cooperate as an electrical switch part of an electrical circuit which is closed when the needle is in closed position and which is open when the needle is either in ballistic mode or in fully open position. In the alternative above mentioned, the electrical circuit is only open in ballistic mode as it closes again when the needle reaches the fully open position. Consequently, a 0-1 step signal can be measured and entered in an electronic control unit (ECU) controlling the fuel injection equipment as a feedback signal which is taken into account in the parameters of the control algorithm of the fuel injection equipment.

Such close loop means have been disclosed following various embodiments in applications PCT/EP2014/073662, FR3013080 and FR1457078.

Nowadays, the demands are constantly rising and the requests for more stringent performances and improved anti-pollution behavior are required. Indeed under very high pressure and very fast needle displacements, the needle member can slightly bend or be angled relative to the nozzle body axis and, when the needle reaches the closed position an initial contact between the two seating faces occurs before they get in sealing abutment closing the fluid communication toward the spray holes. Another reason for this effect can also be a slight misalignment between the upper guide and the lower guide, said misalignment being related to manufacturing tolerances. When said initial contact occurs, the electrical circuit closes and a closing signal is sent to the ECU while indeed, the fluid communication is not yet perfectly sealed, the needle continuing its closing displacement in sliding with friction against the inner wall of the nozzle body. This inaccuracy of needle closed position allows for fuel droplets to form and exit the spray holes when this should not happen.

Similarly, when an injection event is commanded by the ECU, the needle member starts to lift off but, during the initial stage of the move, the two seating faces maintain a temporary partial contact while the fluid communication already opens.

Both in closing and in opening mode, the ECU receives an incorrect signal corresponding to a closed position of the needle while indeed, it is still, or already, open.

SUMMARY OF THE INVENTION

It is an object of the invention to resolve or at least mitigate the above mentioned problem by providing a nozzle assembly of a fuel injector, the nozzle assembly comprising a nozzle body having a peripheral wall defining an internal bore in which a needle member extending from a head extremity to a pointy extremity is slidably guided and is adapted to translate under the influence of a differential of pressure between the pressure in a control chamber, generating a closing force on the head of the needle and, the pressure on the pointy extremity generating an opening force on said needle, the needle translating between a closed position.

Also, a moving seating face integral to the pointy extremity of the needle is in sealing contact against a fixed seating face integral to the nozzle body thus closing a fluid communication and forbidding fuel injection via spray holes arranged through the peripheral wall of the nozzle body and, an open position wherein the moving seating face is lifted away from the fixed seating face thus opening said fluid communication and enabling fuel injection through the spray holes.

The nozzle assembly is further provided with an electrical circuit comprising the needle member, the nozzle body, isolation means preventing electrical contact between the needle member and the nozzle body when the needle is in ballistic mode, between the open and the closed positions and, conductive means enabling electrical contact between the moving seating face and the fixed seating face when the needle is in closed position so that, an electrical signal enabling contact detection between the two seating faces is measurable between the needle member and the nozzle body.

Advantageously, the nozzle assembly further comprises a piezoresistive device configured to continuously vary said electrical signal during the final closing displacements, or the initial opening displacements, of the needle, the variations of the signal being a function of the differential of pressure.

Also, the piezoresistive device is arranged to transmit the closing force to the nozzle body.

More particularly, the piezoresistive device is a coating applied on the moving seating face, or on the fixed seating face, or on both faces.

Also, the piezoresistive device can be an independent member combined to the needle member.

In the latter case, the needle has a main portion comprising the head extremity and a pointy portion comprising the pointy extremity of the needle, the piezoresistive member being inserted between said main and pointy portions.

Preferably, the piezoresistive member is in the close vicinity to the pointy extremity of the needle but alternatively, the piezoresistive member can be arraged anywhere in the needle.

The piezoresistive device is configured to continuously vary the electrical signal when the pressure in the control chamber rises up so said closing force becomes predominant over the opening force such that the needle moves and approaches the closed position, the electrical signal continuously varying from a closed level measureable when occurs the initial contact of the needle with the nozzle body, said fluid communication still being open, to a second level measureable when occurs the full closing of the needle sealing said fluid communication.

Also, the piezoresistive device is configured to continuously vary the electrical signal when the pressure in the control chamber drops down so the opening force becomes predominant over the closing force such that the needle in closed position initiates an opening displacement, the electrical signal continuously varying from said second level to an open level measureable when occurs the ultimate contact of the needle with the nozzle body said fluid communication being already open.

Furthermore, the piezoresistive device might comprehend a diamond-like carbon (DLC).

The invention further extends to a fuel injector comprising a nozzle assembly as described above and a control valve assembly adapted to open or to close a spill orifice enabling variations of the pressure in the control chamber.

The invention further extends to an electronic control unit (ECU) (or Engine control unit, but in all the literature I can remember was always control unit) adapted to be connected to a fuel injector as described above, the ECU being adapted to receive the electrical signal measured between the needle member and the nozzle body and, being configured to deliver an opening or a closing command signal to the control valve, said command signal being computed as a function of said electrical signal.

The invention further extends to fuel injection equipment (FIE) controlled by an electronic control unit as described above.

The invention further extends to a method to control FIE as described above, the method comprising the step of identifying the closing of the fluid communication between the high pressure circuit and the spray holes as a function of the variations of the electrical signal measured between the needle and the nozzle body of an injector of the FIE.

identifying the opening of the fluid communication between the high pressure circuit and the spray holes as a function of the variations of the electrical signal measured between the needle and the nozzle body of an injector of the FIE.

commanding the control valve to open or to close the spill orifice as a function of the electrical signal measured between the needle and the nozzle body.

BRIEF DESCRIPTION OF THE DRAWINGS

The present invention is now described by way of example with reference to the accompanying drawings in which.

DESCRIPTION OF THE PREFERRED EMBODIMENTS

Figure 1:
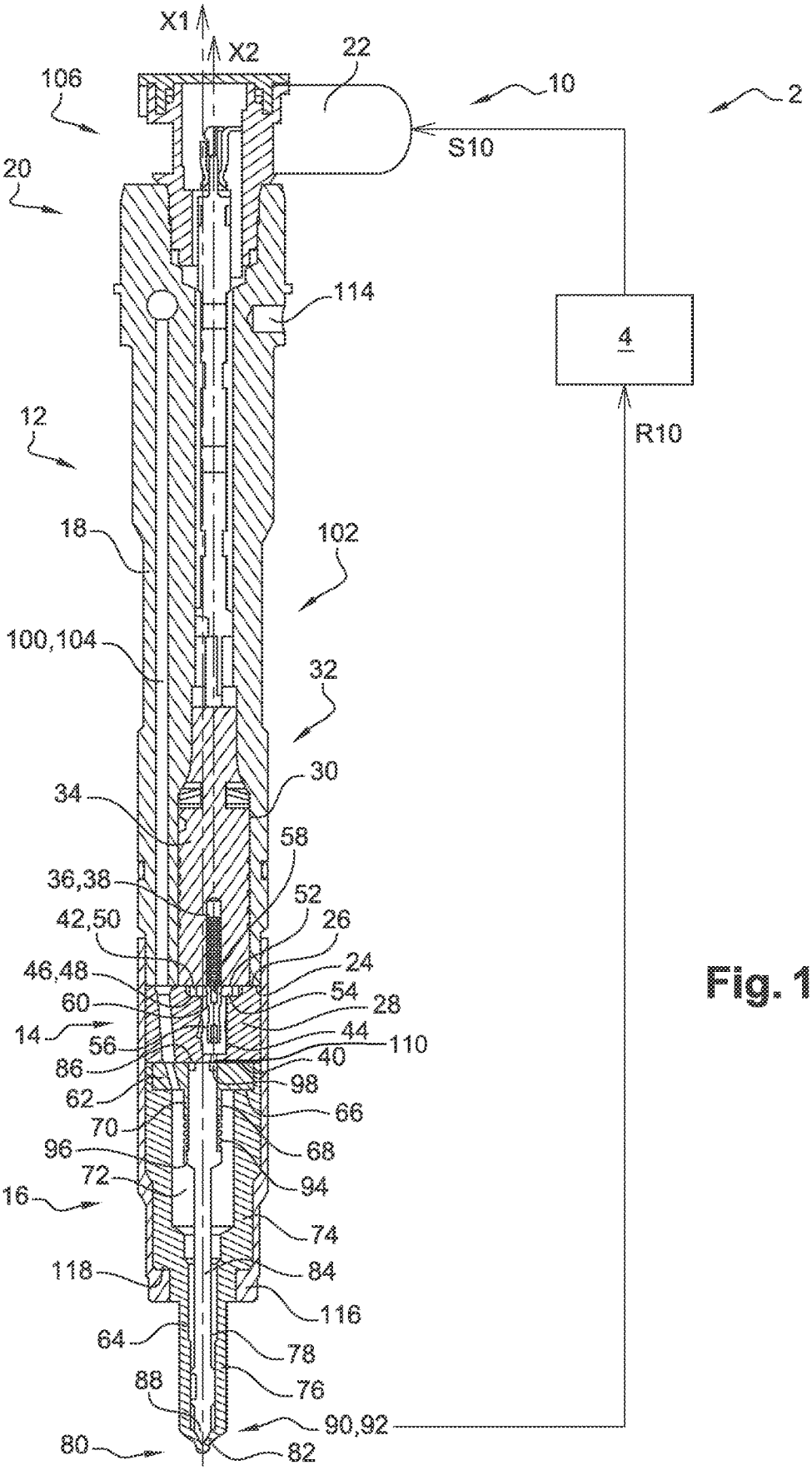
FIG. 1 is a side view of a fuel injector connected to an electronic control unit.

In reference to FIG. 1 is sketched a block diagram representing part of a fuel injection equipment (FIE) 2 controlled by an electronic control unit (ECU) 4 sending command signals S10 toward other components of the FIE 2 and, receiving feedback signals R10 from said components. Particularly detailed on the figure is a fuel injector 10 receiving from the ECU a command signals S10 and sending a feedback signal R10 to the ECU 4.

The injector 10, now described, has an elongated shape extending along a main axis X1. According to the arbitrary and non-limiting orientation of the figure, the injector 10 comprises from top to bottom the stack of an actuator assembly 12, a control valve assembly 14 and a nozzle assembly 16.

The actuator assembly 12 comprises a cylindrical actuator body 18 axially X1 extending from a top extremity 20, where is arranged an electrical connector 22, to a lower face 24 having a mirror surface finish in order to be in sealing facial abutment against the upper face 26 of the body 28 of the control valve assembly 14. A bore 30, provided in the actuator body 18, opens in said lower face 24, said bore 30 upwardly extending inside the actuator body 18 along a valve axis X2 toward an upward bottom 32. From said upward bottom 32 upwardly extends a conduit for electrical cables to connect to the terminals of the connector 22. Inside the bore 30 is arranged an electrical solenoid 34, itself having an internal bore 36 in which is arranged a first spring 38.

As visible on the figure, the valve axis X2 is parallel and slightly offset from the main axis X1. This characteristic introduced in EP0740068 presents multiple advantages particularly easing the internal arrangement of the injector. Nevertheless, although the injector illustrating the present invention is provided with such offset axes, other injectors with aligned axes can also benefit from the invention.

Also, other injectors provided for instance with an additional filling valve can benefit from the invention.

The body 28 of the control valve assembly 14 axially X1 extends from said upper face 26 to an opposed lower face 40 and, in the body 28 an armature and spool valve assembly 42 is slidably arranged to slide in a hydraulic distribution bore 44 extending along the valve axis X2 and opening in the bottom face 46 of a large recess 48 provided in the upper face 26 of the body of the control valve. Said armature and spool valve assembly 42 comprises a disk-like magnetic armature 50 arranged in the recess 48, the armature 50 having an upper face 52 facing the solenoid 34, an opposed lower face 54 facing the bottom face 46 of the recess and, a central through hole in which a spool shaft 56 is inserted and crimped. The spool shaft 56 is, at its upper face 58, flush in surface with the upper face 52 of the armature and, it downwardly projects from the lower face 54 of the armature extending in the hydraulic bore 44. When arranged in place in the injector 10, the first spring 38 that is inside the solenoid is compressed between the bottom of the bore 36 and the upper face 58 of the spool shaft 56, so that the spring 38 permanently pushes the armature and spool valve assembly 42 away from the solenoid.

Furthermore, the opening of the hydraulic bore 44 in said bottom face 46 of the recess defines a valve seat 60 that is either open or closed depending on the position in the hydraulic bore 44 of the armature and spool assembly 42.

The nozzle assembly 16, now described, comprises a two-part body made of an upper guide member 62 combined to a lower nozzle body 64. The upper face 66 of the upper guide member 62 is in in sealing facial abutment against the lower face 40 of the body of the control valve assembly and, said upper guide member 62 downwardly extends to a lower face 66 in the centre of which downwardly protrudes a turret 68. The upper guide member 62 is also provided with an axial X1 through bore 70 opening in the upper face 66 and also in the bottom face of the turret 68. The turret 68 projects inside a larger bore 72 centrally defined by the peripheral wall 74 of the lower nozzle body 64. Said peripheral wall 74 downwardly extends into a narrower portion 76 of the nozzle body, the larger bore 72 continuing into a smaller bore 78 that ends in a pointy extremity 80 where are arranged spray holes 82 extending through the peripheral wall 74.

The invention can also be utilized with other injectors where the nozzle body is made of on piece.

The nozzle assembly 16 further comprises a valve member 84, also called needle in reference to its elongated shape extended from a flat head extremity 86 to a pointy extremity 88, the needle 84 being slidably arranged in the two-part body, the head extremity 86 being guided in the through bore 70 that is in the upper guide member, the lower extremity of the needle being guided in the smaller bore 78 that is inside the lower nozzle body. The needle 84 is integrally provided with a moving seating face 90 that is a male conical face surrounding the needle and arranged in the pointy extremity 88 of the needle, said moving seating face 90 being adapted to cooperate with a fixed seating face 92 that is a female conical face surrounding the inner face of the peripheral wall 74, said fixed seating face 92 being in the vicinity of the pointy extremity 80 of the smaller bore 78 right above the spray holes 82.

A second spring 94 arranged surrounding the needle 84 and compressed between the bottom face of the turret 68 and a shoulder face 96 integral to the needle 84 constantly biases the needle 84 toward a closed position CPN where the moving seating face 90 abuts against the fixed seating face 92.

In the upper guide member 62, the volume inside the through bore 70 and above the head extremity 86 of the needle defines a control chamber 98 which role, although being well known by any person skilled in the art, will be briefly re-explained below.

The injector 10 is provided with fuel circulation means comprising a high pressure circuit 100 and a return circuit 102. The high pressure circuit 100 comprises a main conduit 104 extending in a plurality of aligned sections from an inlet 106, arranged in the upper portion of the injector, down to an opening in the lower face 66 of the upper guide member. The high pressure circuit 100 then continues in the bore 72, 78, defined in the lower nozzle body downward to the spray holes 82. The high pressure circuit 100 also comprises a lateral branch or secondary conduit 108 extending from the main conduit 104 to the control chamber 98.

The return circuit 102 comprises a spill orifice 110 extending from the control chamber 98 up to the hydraulic distribution bore 44, wherefrom said return circuit 102 prolongs in said hydraulic bore, through the valve seat 60, in the large recess 48 then, via a return low pressure conduit 112 upwardly extending to an outlet 114.

The different constituents of the injector 10 are firmly maintained together by a capnut 116 through which is inserted the narrow portion 76 of the lower nozzle body, the capnut 116 abutting on an external shoulder face 118 of said lower nozzle body 64 and, upwardly extending surrounding the control valve assembly 14 up. The capnut 116 is screwed tight on a male thread provided on the external face of the actuator body 18.

As it is sketched on FIG. 1, the command signal S10 received by the injector 10 commands to energize, or not, the solenoid 34 which, when energized generates a magnetic field M upwardly attracting the magnetic armature 50 toward the solenoid.

Also, the injector 10 is provided with means to enable feedback signal R10 providing information to the ECU 4 about the closed position CPN of the needle and, more particularly about the moving seating face 90 abutting against the fixed seating face 92. Indeed, the two-part nozzle body 62, 64, and the needle member 84 are part of an electrical circuit C wherein the needle 84 is electrically isolated from the body 62, 64, to the exception of the two seating faces 90, 92, that remain electrically conductive. The electrical isolation can for instance be provided thanks to electrical isolation coating applied on the needle 84 or internally in the nozzle body, or alternatively thanks to ceramic inserts adequately arranged or, any other isolation means or combination of isolation means.

When the needle 84 is in closed position CPN, the seating faces 90, 92, being in contact against each other, the circuit C is electrically closed and a measure of the signal R10 identifying the closed position CPN can be performed.

To the opposite, when the moving seating face 90 lifts away from the fixed seating face 92, the needle 84 being in a ballistic mode moving toward an open position OPN, the needle 84 is entirely isolated from the nozzle body, the electrical resistance between the needle 84 and the nozzle body is infinite, the circuit C is electrically open and, another measure of the signal R10 identifying the ballistic, or non-closed, position of the needle can be recorded.

For instance, when an electrical current travels the circuit C, a difference of potential, measured in Volt, or a resistance measured in Ohms, can be obtained between the needle 84 and the nozzle body 64. In this case, should the circuit be closed, the feedback signal R10 is null as there is no difference of potential. To the contrary, when the circuit C is open the value of the signal R10 changes.

Injectors have been described wherein a similar electrical circuit is electrically closed when the needle is in closed position and also, when the needle is in fully open position, the electrical circuit being electrically open only when the needle is in ballistic mode between said two extreme positions. The present invention can be used with any type of injectors.

To overcome the bending or misalignment problems initially mentioned, the injector 10 is provided with electrical conductive means enabling to monitor the final displacements of the needle approaching the closed position, or to monitor the initial displacements of the needle lifting toward the open position.

Figure 2:
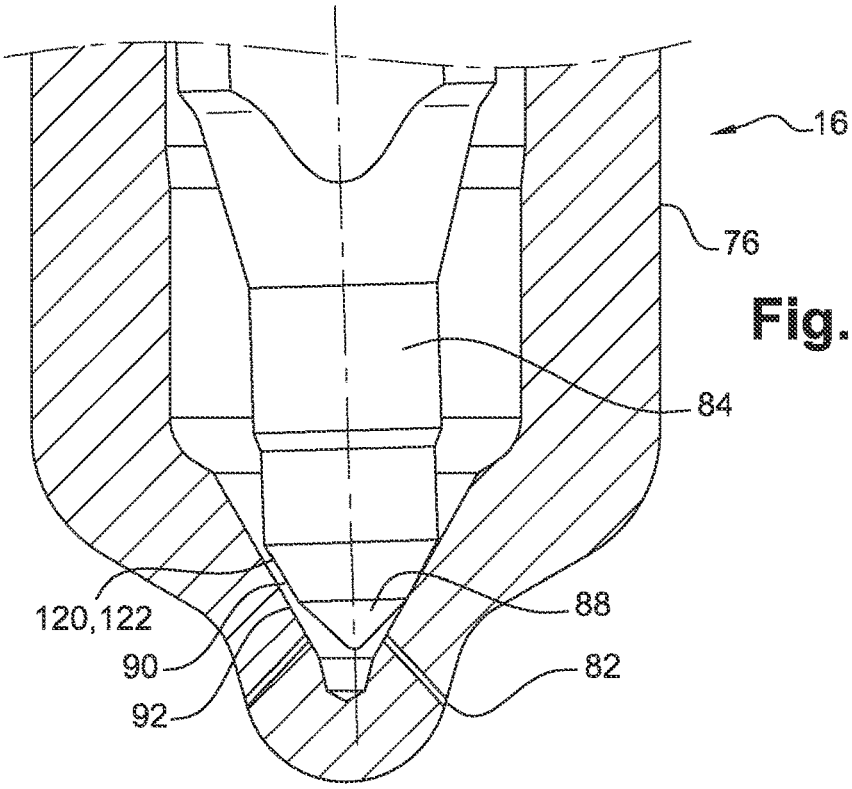
FIG. 2 is a magnified section of the nozzle assembly of the injector of FIG. 1, the nozzle assembly being configured as per a first embodiment of the invention and being in an initial closing state.
Figure 3:
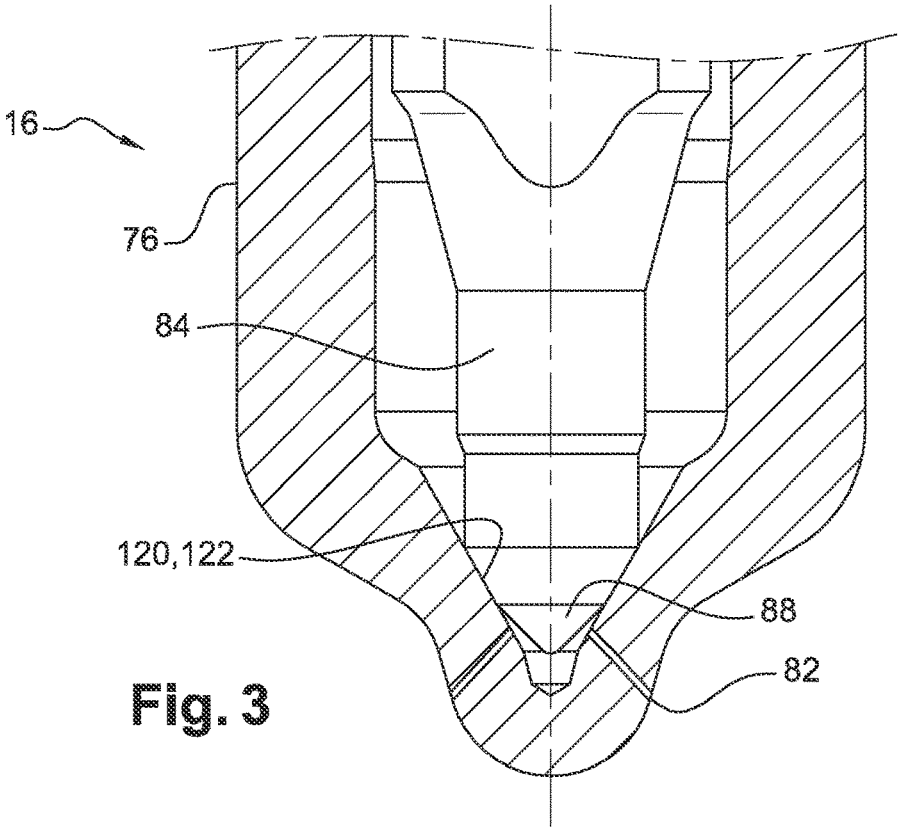
FIG. 3 is similar to FIG. 2, the nozzle assembly being in a final closing state.

Said conductive means comprise a piezoresistive device 120, a first embodiment of which being now described in reference to FIGS. 1, 2 and 3.

The piezoresistive device 120 is a coating film 122 applied on the moving seating face 90 or, alternatively on the fixed seating face 92, or on both faces. Diamond-like carbon (DLC) is a suitable piezoresistive material for this use. In the present application, piezoresistive is to be understood as a material property where a material varies its electrical resistance as a function of the mechanical force applied on the material and holds said electrical resistance as long as said force is applied. In the particular context of this application, the piezoresistive device 120 has a known electrical resistance when it is not subject to a compression force and, when a force is applied to it, the resistance decreases as a function of the force.

In FIGS. 2 and 3 are magnified the lower tip area of the nozzle assembly 16. In FIG. 2, the ECU 4 has commanded to the control valve assembly 14 to close the valve seat 60 and, to do this, the signal S10 sent to the injector 10 prevents energizing the solenoid 34 and, therefore the first spring 38 pushes the armature and spool valve assembly 42 away from the solenoid 34, closing the valve seat 60. As the valve seat 60 is closed the fuel pressure in the control chamber rises up and generates on the head 86 of the needle a closing force FC that downwardly biases the needle 84. As the needle 84 approaches the closed position CPN, a first contact happens between the moving seating face 90 and the fixed seating face 92. This state is magnified on FIG. 2. The piezoresistive coating 122 was not solicited during the ballistic travel of the needle and, as this first contact happens, the piezoresistive coating 122 starts to be compressed. The property of the piezoresistive coating film is that when it is not solicited, its electrical resistance is very high and, as it starts to be compressed since the needle 84 continues to close, the electrical resistance of the coating reduces. The electrical resistance of the coating film is a function of the compression to which it is subjected. The electrical circuit C closes and a first measure R10-C of the feedback signal R10 provides accurate information of the needle position. When happens this initial closing of the circuit C, the fluid communication between the high pressure circuit 100 and the spray holes 82 remains open and fuel injection still occurs.

As the ECU 4 receives this first measure of the feedback signal R10-C, the ECU 4 understands, because of the value of the signal R10-C, that the needle is not fully closed and then it continues to command closing of the valve seat 60, the pressure inside the control chamber 98 continuing to be at a high level and the needle 84 continuing to be pushed downward toward the state represented on FIG. 3 where the moving seating face 90 is now in perfect sealing abutment against the fixed sealing face 92, the contact entirely circumventing the spray holes 82, closing said fluid communication and thus preventing fuel injection. In this fully closed state, depicted in FIG. 3, the piezoresistive coating 122 is fully compressed as it transmits entirely the closing force FC between the seating faces 90, 92. The electrical circuit C is closed, the electrical resistance of the coating film is minimized, if not null, and a second measure of the feedback signal R10-M informs the ECU 4 of the fully closed position of the needle wherein fuel injection is prevented. Between said two positions depicted on FIGS. 2 and 3, the needle downwardly slides and the friction increases the compression of the piezoresistive coating. The magnitude of signal R10 being a function of the compression of the coating, said signal R10 continuously varies as the compression continuously increases.

Without refereeing to a specific figure, when the ECU 4 commands to the control valve assembly 164 to open the valve seat 60, the signal S10 is sent to enable energizing the solenoid 34. When energized, the magnetic field M generated attracts the armature 50 which pulls up the spool shaft 56 opening the valve seat 60. The fuel that was captured under pressure in the control chamber 98 is now free to exit through the open spill orifice 110 and to flow in the return circuit 102 toward the outlet 114. The pressure in the control chamber 98 drops down to a point where the closing force FC reduces and an opening force FO generated by the pressurized fuel on the pointy extremity 88 of the needle becomes predominant and biases the needle 84 toward opening. The needle 84 that is in closed position as shown on FIG. 3 initiates an upward displacement during which the needle slides with friction against the nozzle body. The pressure and the area of contact between the two seating faces 90, 92, reduces, the piezoresistive coating being less solicited, its electrical resistance increases and the feedback signal R10 evolves from said second measure to a third level R10-O that is measured when the ultimate contact between said two seating surfaces 90, 92, happens.

It is to be clearly understood that during these final closing displacement and initial opening displacement, the electrical resistance of the piezoresistive film continuously varies, the signal R10 continuously varying accordingly and continuously informing the ECU 4 about the exact state of the needle 84 and consequently about the fluid communication to the spray holes 82.

Good tests results have been obtain with piezoresistive coating film having thicknesses from 0.5 μm to 2 μm. The exact thickness of the coating film depends also on the intended use. For instance higher is the maximum pressure in the control chamber; thicker should be the piezoresistive film.

Also, DLC is a large material family, all members of the family not having the same piezoresistive properties. DLC comprising titanium, chromium or silicon additives seem to perform better.

Figure 4:
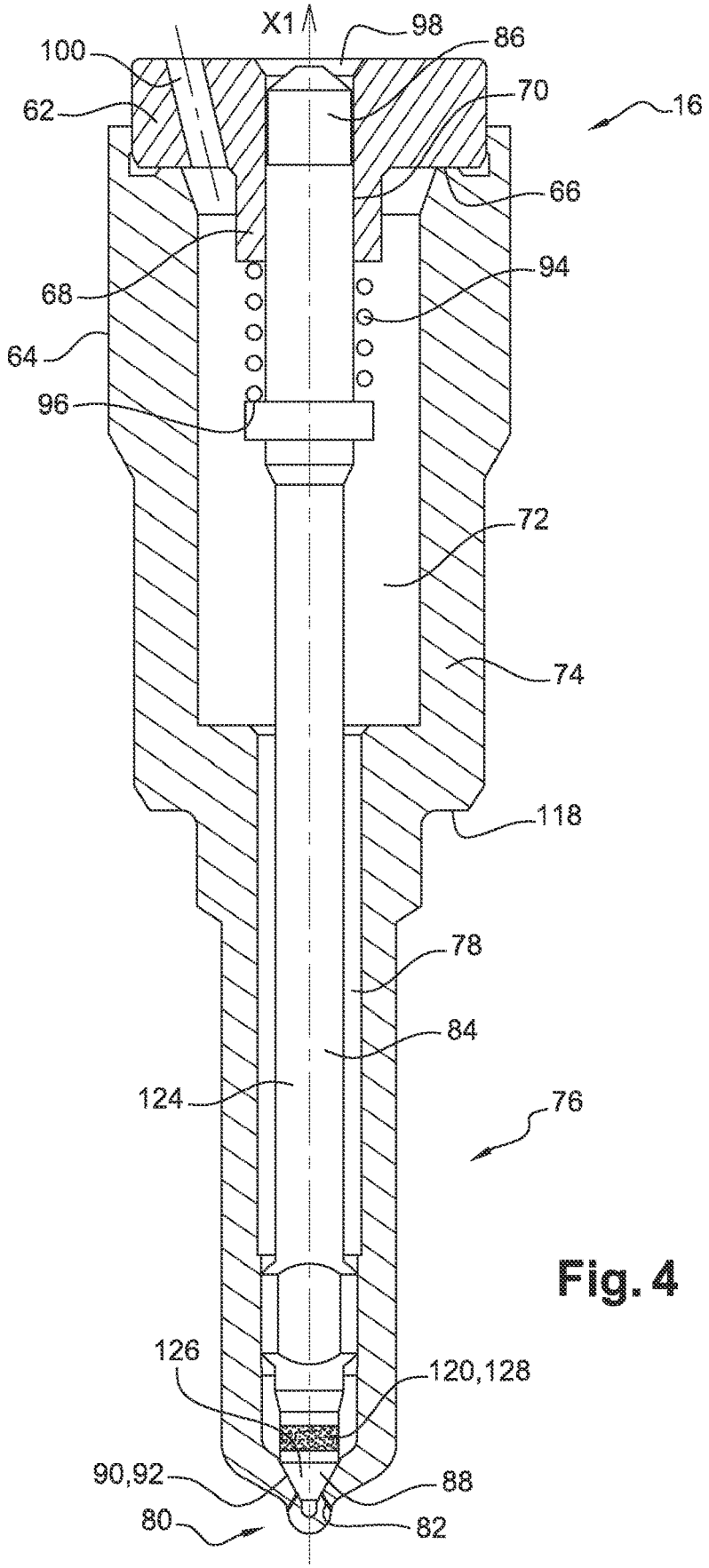
FIG. 4 is a magnified section of the nozzle assembly of the injector of FIG. 1, the nozzle assembly being configured as per a second embodiment of the invention and being in an initial closing state.

A second embodiment of the invention depicted on FIG. 4 and operating as per a similar principle is now described.

In this second embodiment, the needle member 84 comprises a main portion 124 on the head side and a distinct small pointy portion 126 wherein is arranged the moving seating face 90. In between said two portions of the needle is inserted the piezoresistive device 120 that is, in this second embodiment, a piezoresistive member 128 fixedly combined to the two needle portions 124, 126. As shown on the figure, the main portion 124 is much longer that the pointy portion 126, the piezoresistive member 128 being arranged in the close vicinity to the pointy extremity 88 of the needle.

The operation of this second embodiment is similar to the description made above for the first embodiment, the piezoresistive member 128 continuously varying its electrical resistance as a function of the intensity of the compression force it is subjected to. As a direct consequence, the feedback signal R10 varies as a function of the state of contact between the two seating faces 90, 92 and, especially to distinctively measure the first R10-C, second R10-M and third level R10-O of measures of the feedback signal R10.

In alternative embodiments not represented, the piezoresistive member 128 can be arranged more toward the middle or even toward the head of the needle 84. In yet other alternatives the piezoresistive member 128 can constitute the pointy extremity itself.

Figure 5:
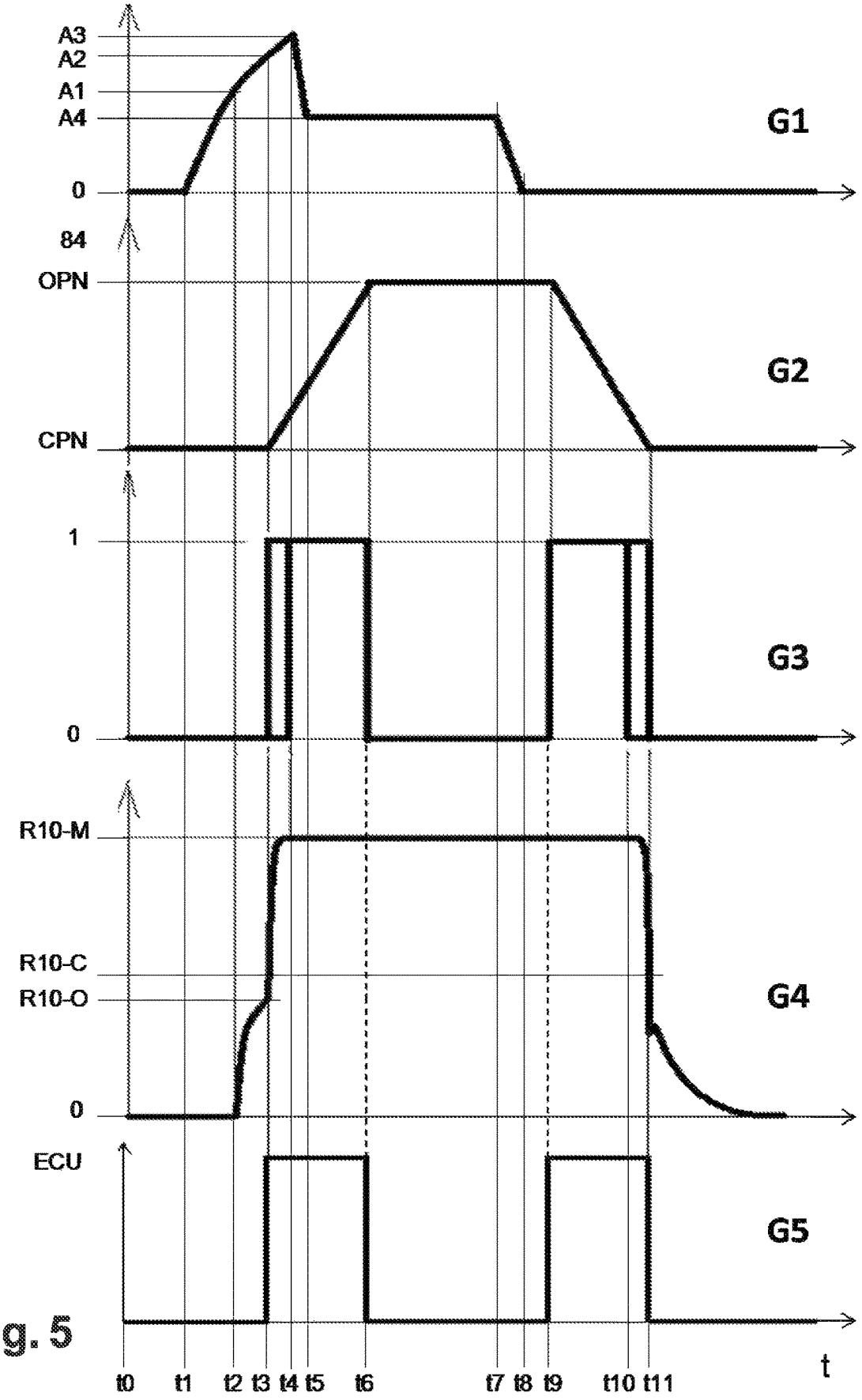
FIG. 5 is a series of five graphs (G1-G5) representing signals taken into account in the process of commanding the injector of FIG. 1.

According to FIG. 5 are now described five graphs G1-G5 illustrating a method 200 executed by the ECU 4 for controlling the operation of the FIE 2 and in particular the injector 10.

All the graphs G1-G5 share the same parallel time axis enabling to relate each graph to the others and describing the evolution of all the parameters. The description below is time based describing said relations between the graphs.

Initially at time t0, (all graphs G1-G5) the ECU commands (214) not to energized the solenoid (G1), the armature and shaft assembly is biased by the first spring to closing the valve seat 60 maintaining the pressure in the control chamber at a high level, thus generating a predominant closing force FC maintaining the needle is in closed position CPN (G2). The electrical circuit C is electrically closed and, in this example (G3), a current is sent into the circuit C and the feedback signal R10 measured is the electric potential difference, measured in Volt, between the needle and the nozzle body, said measure being then null. The feedback signal R10 is sent to the ECU.

At time t1 (G1) occurs the first event, the ECU 4 commands (214) to energize the solenoid and the driving current starts rising.

At time t2, the driving current has reached a first intermediate value A1 (G1), the valve seat 60 is open and the pressure in the control chamber drops as the fuel therein exits to the return circuit. The needle is still in closed position CPN (G2) but the opening force FO and the closing force FC are now balanced (G4). The two seating faces are still in contact and the electrical circuit C is still closed (G3). The feedback signal R10 sent to the ECU remains null.

Between time t2 and a subsequent time t3, the driving current continue rising (G1) toward a second intermediate level A2, the needle remains in closed position CPN (G2), the electrical circuit C remains closed (G3), the pressure in the control chamber continues to drop and the closing force FC diminishes so the pressure over the piezoresistive device reduces and the feedback signal R10 sent to the ECU continuously varies (G4) between time t2 and time t3.

At time t3, the driving current has reached the second intermediate level A2 (G1), the opening force FO has become predominant over the closing force FC and the needle initiates an opening lift off (G2), the electrical circuit C is still closed (G3) but the electrical contact between the two seating faces has evolved and the feedback signal R10 sent to the ECU has now varied from being null to now being at an open level R10-O, previously named as the third level (G4). In its method (200) of control, the ECU identifies (212) this instant t3 to be the starting point of the injection (G5) as it is computed to be the initial opening instant of the fluid communication.

Between time t3 and a time t4 the driving current continuously raises toward a maximum value A3 (G1), the needle continues to lift-off (G2) and during this phase between times t3 and t4, the contact pressure between the two seating faces reduces from a maximum value, at t3, to zero at t4. On the graph G3 it has been chosen to represent two parallel boundary lines limiting the initial lift phase displacement of the needle. In case of a perfectly straight needle, times t3 and t4 are combined and simultaneous and, in case, of a heavily bent needle, times t3 and t4, are rather distant from each other. During this time phase, t3, t4, the area and contact pressure between the two seating faces reduces toward an ultimate contact. The electrical resistance of the piezoresistive device increases and the feedback signal R10 sent to the ECU continues to continuously vary.

At time t4, the driving current is at its maximum value A3 (G1), the needle continues to lift off (G2) and enters the ballistic mode, the electrical circuit C opens (G3) has the ultimate contact between the two seating faces is reached; the feedback signal sent to the ECU is now at a maximum value R10-M (G4).

Between time t4 and time t5, the ECU commands (214) to drop down the driving current to a steady level A4 (G1), the needle continues to move toward the open position (G2), the electrical circuit C is now open (G3), the feedback signal remains at the maximum value R10-M (G4) and ECU records an injection event (G5).

Between time t5 and a time t6, the ECU commands (214) to the driving current to remain at the steady level A4 (G1), the needle reaches the open position OPN (G2), in the example chosen, and electrical circuit C closes again (G3) as another feature not detailed, establishes another electrical contact between the needle and the nozzle body. Such a contact can for instance be closed between the head face of the needle and the ceiling face of the control chamber, both faces being in contact when the needle is in full open position. The opening force FO remains predominant and the feedback signal remains at its maximum level R10-M, previously identified as the second level.

Between time t6 and a time t7 (G1), the needle remains in open position.

At time t7, the ECU sends a closing command (214) stopping to energize the solenoid (G1).

Between time t7 and a time t8 driving current drops from the steady level A4 down to null (G1). The armature is no longer attracted toward the solenoid and the first spring pushes the spool shaft back to closing the valve seat, thus preventing fuel exit through the spill orifice and forcing the pressure to rise again in the control chamber, increasing the closing force FC.

At a time t8, the driving current is null (G1).

Between time t8 and a time t9 the pressure in the control chamber rises up.

At time t9 the closing force FC just becomes predominant over the opening force FO and the needle initiates a closing displacement (G2). The electrical circuit C opens again (G3). Other parameters remain unchanged.

Between time t9 and a time t10, the needle travels toward the closed position CPN (G2). Other parameters remain unchanged.

At time t10, the initial contact between the two seating faces occurs and the circuit C start to close (G3) closing the electrical circuit C. The feedback signal R10 sent to the ECU starts to vary.

Between time t10 and a time t11, the needle is in final closing displacement (G2), the electrical circuit C closes (G3) and, the contact area and pressure between the two seating face varies so that the feedback signal sent to the ECU varies from the maximum level R10-M to a closing level R10-C (G4) previously identified as the first level. During this time phase between times t3 and t4, the contact pressure between the two seating faces increases from zero, at time t10 to a maximum value, at tn. Similarly to the lift-off phase, it has been chosen to represent on the graph G3 two parallel boundary lines limiting the final closing phase displacement of the needle. In case of a perfectly straight needle, times t10 and t11 are combined and simultaneous and, in case, of a heavily bent needle, times t10 and t11, are rather distant from each other.

At time t11, the needle has reached the closed position (G2), the electrical circuit is closed (G3), the feedback signal is at the closing level R10-C (G4) that is identified (210) by the ECU as the instant when the fluid communication is closed and the injection is finished (G5).

After time t11, the feedback signal R10 continues to drop to zero as the other parameters remain.

LIST OF REFERENCES

2 fuel injection equipment (FIE)
4 electronic control unit (ECU)
10 fuel injector
12 actuator assembly
14 control valve assembly
16 nozzle assembly
18 actuator body
20 top extremity of the actuator body
22 electrical connector
24 lower face of the actuator body
26 upper face of the body of the control valve assembly
28 body of the control valve assembly
30 bore extending in the actuator body
32 upward bottom of the bore
34 solenoid
36 bore extending in the solenoid
38 first spring
40 lower face of the body of the control valve assembly
42 armature and spool valve assembly
44 hydraulic distribution bore
46 bottom face of the large recess
48 large recess
50 magnetic armature
52 upper face of the armature
54 lower face of the armature
56 spool shaft
58 upper face of the spool shaft
60 valve seat
62 upper guide member
64 lower nozzle body
66 lower face of the upper guide member
68 turret
70 through bore in the upper guide member
72 larger bore inside the lower nozzle body
74 peripheral wall of the lower nozzle body
76 narrow portion of the lower nozzle body
78 smaller bore inside the lower nozzle body
80 pointy extremity lower nozzle body
82 spray holes
84 valve member, needle
86 head extremity of the needle
88 pointy extremity of the needle
90 moving seating face
92 fixed seating face
94 second spring
96 shoulder face on the needle
98 control chamber
100 high pressure circuit
102 return circuit
104 main conduit of the high pressure circuit
106 inlet
108 secondary conduit of the high pressure circuit
110 spill orifice
112 low pressure conduit
114 outlet
116 capnut
118 external shoulder face on the nozzle body
120 piezoelectric device
122 piezoelectric coating—1st embodiment
124 main portion of the needle—2nd embodiment
126 pointy extremity portion—2nd embodiment
128 piezoelectric member—2nd embodiment
200 Method
210 step of identifying closing
212 step of identifying opening
214 step of commanding the control valve
X1 main axis
X2 valve axis
S10 command signal sent to the injector
M magnetic field
CPN closed position of the needle
OPN open position of the needle
C electrical circuit
FC closing force
FO opening force
R10 feedback signal received from the injector
R10-O opening level of the feedback signal
R10-M maximum level of the feedback signal
R10-C closing level of the feedback signal

The invention claimed is:

1. A nozzle assembly of a fuel injector, the nozzle assembly comprising:

a nozzle body having a peripheral wall defining an internal bore in which a needle member extending from a head extremity to a tapered extremity is slidably guided and is adapted to translate under the influence of a differential of pressure between the pressure in a control chamber, generating a closing force on the head of the needle member and, the pressure on the tapered extremity generating an opening force on the needle member, the needle member translating between a closed position, wherein a moving seating face integral to the tapered extremity of the needle member is in sealing contact against a fixed seating face integral to the nozzle body thus closing a fluid communication and forbidding fuel injection from spray holes arranged through the peripheral wall of the nozzle body and, an open position wherein the moving seating face is lifted away from the fixed seating face thus opening the fluid communication and enabling fuel injection through the spray holes;

an electrical circuit comprising the needle member, the nozzle body, isolation means preventing electrical contact between the needle member and the nozzle body when the needle member is in a ballistic mode, between the open position and the closed position and, conductive means enabling electrical contact between the moving seating face and the fixed seating face when the needle member is in the closed position so that, an electrical signal enabling contact detection between the moving seating face and the fixed seating face is measurable between the needle member and the nozzle body; and a piezoresistive device configured to continuously vary the electrical signal during final closing displacements, or during initial opening displacements, of the needle member, variations of the electrical signal being a function of the differential of pressure;

wherein, the piezoresistive device is configured to continuously vary the electrical signal when the pressure in the control chamber rises up so the closing force becomes predominant over the opening force such that the needle member moves and approaches the closed position, the electrical signal continuously varying from a closed level measurable when initial contact of the needle member with the nozzle body occurs and the fluid communication is still open, to a second level measurable when full closing of the needle member occurs thereby sealing the fluid communication; and the piezoresistive device is configured to continuously vary the electrical signal when pressure in the control chamber drops down so the opening force becomes predominant over the closing force such that the needle member in the closed position initiates an opening displacement, the electrical signal continuously varying from the second level to an open level measurable when ultimate contact of the needle member with the nozzle body occurs and the fluid communication being already open.

2. A nozzle assembly as claimed in claim 1 wherein, the piezoresistive device is arranged to transmit the closing force to the nozzle body.

3. A nozzle assembly as claimed in claim 2 wherein, the piezoresistive device is a coating applied on the moving seating face or on the fixed seating face.

4. A nozzle assembly as claimed in claim 1 wherein, the piezoresistive device is an independent member combined to the needle member.

5. A nozzle assembly as claimed in claim 4 wherein, the needle member has a main portion comprising the head extremity and a tapered portion comprising the tapered extremity of the needle member, the piezoresistive device being inserted between the main portion and the tapered portion.

6. A nozzle assembly as claimed in claim 1 wherein the piezoresistive device comprises diamond-like carbon.

7. A nozzle assembly as claimed in claim 1 further comprising a control valve assembly adapted to open and to close, thereby enabling variations of pressure in the control chamber.

8. An electronic command unit adapted to be connected to the fuel injector as claimed in claim 7, the electronic command unit being adapted to receive the electrical signal measured between the needle member and the nozzle body and, being configured to deliver a command signal to the control valve assembly which opens and closes the control valve, the command signal being computed as a function of the electrical signal.

9. A method to control the fuel injector as claimed in claim 7, the method comprising the step of identifying closing of the fluid communication between a high pressure circuit and the spray holes as a function of variations of the electrical signal measured between the needle member and the nozzle body.

10. A method as claimed in claim 9 further comprising the step of identifying opening of the fluid communication between the high pressure circuit and the spray holes as a function of the variations of the electrical signal measured between the needle member and the nozzle body.

11. A method as claimed in claim 9 further comprising the step of commanding the control valve assembly to open or to close a spill orifice as a function of the electrical signal measured between the needle member and the nozzle body.

* * * * *